United States Patent [19]

Mulle, Jr. et al.

[11] Patent Number: 5,036,601

[45] Date of Patent: Aug. 6, 1991

[54] PLASTIC AIR DIFFUSER FOR HAIR DRYERS

[75] Inventors: Theodore B. Mulle, Jr., Ridgefield; Victor A. Mireles, Stamford, both of Conn.

[73] Assignee: Conair Corporation, Stamford, Conn.

[21] Appl. No.: 563,523

[22] Filed: Aug. 6, 1990

[51] Int. Cl.[5] ..... A45D 20/00

[52] U.S. Cl. ..... 34/97; 34/243 R; 239/602; 239/DIG. 12

[58] Field of Search ..... 34/96, 97, 98, 90, 91; 219/373; 239/289, 567, 602, DIG. 12; 132/271

[56] References Cited

U.S. PATENT DOCUMENTS 4,230,279 10/1980 Forsberg ..... 34/97

4,391,047 7/1983 Janssens et al. ..... 34/97

4,590,687 5/1986 Caruso ..... 34/97

4,848,007 7/1989 Montagnino ..... 34/97

*Primary Examiner*—Henry A. Bennett

*Assistant Examiner*—Denise L. F. Gromada

*Attorney, Agent, or Firm*—Haynes N. Johnson

[57] ABSTRACT

An air diffuser for a hair dryer having a porous diffuser face, panels secured to the diffuser face and to one another to form a plenum chamber. A spout is attached to the plenum chamber on the side opposite the diffuser face. When the spout is fitted about the air outlet of a hair dryer, the air will pass through the plenum chamber and be diffused as it passes out through the diffuser face. The face and the panels are formed of flexible, plastic sheet material.

7 Claims, 3 Drawing Sheets

Fig. 1.
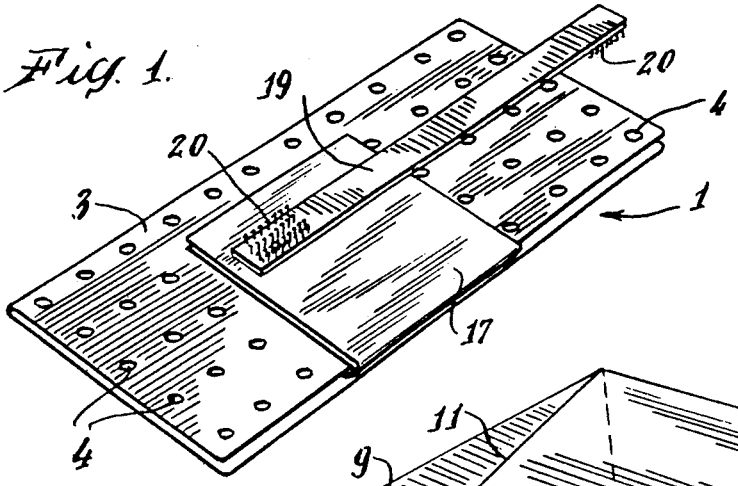
Fig. 2.
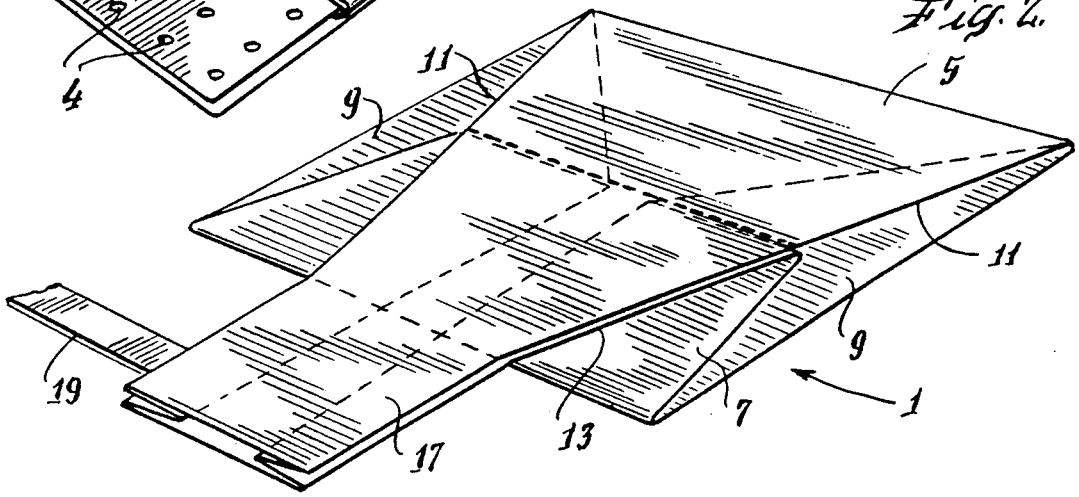
Fig. 3.
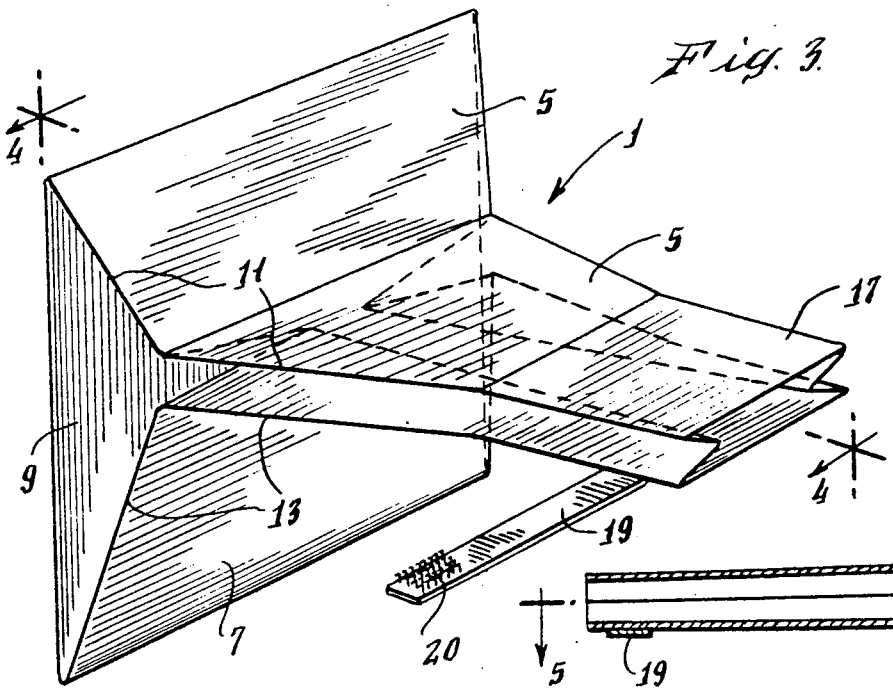
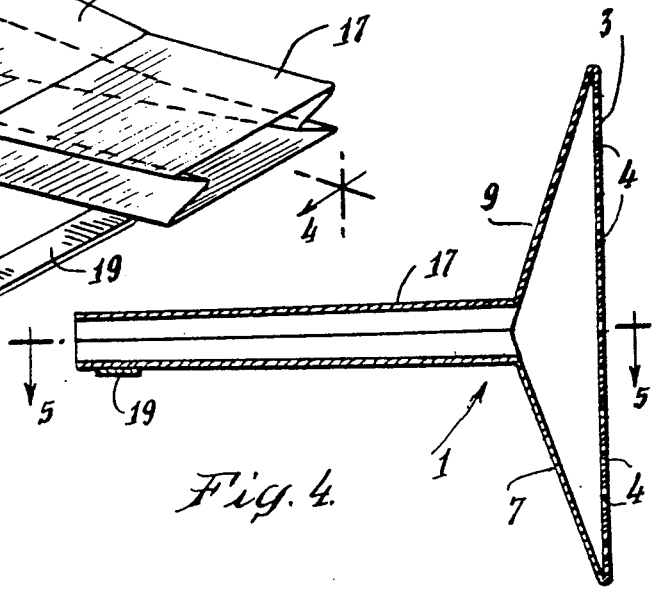
Fig. 4.

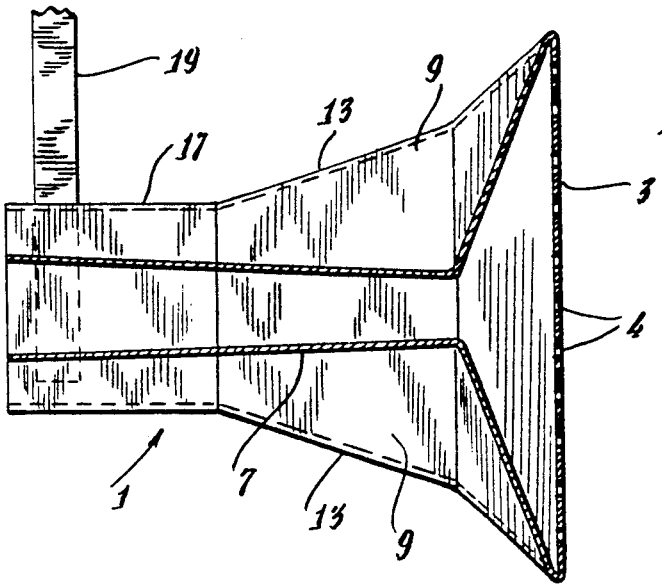
Fig. 5.
Fig. 6.
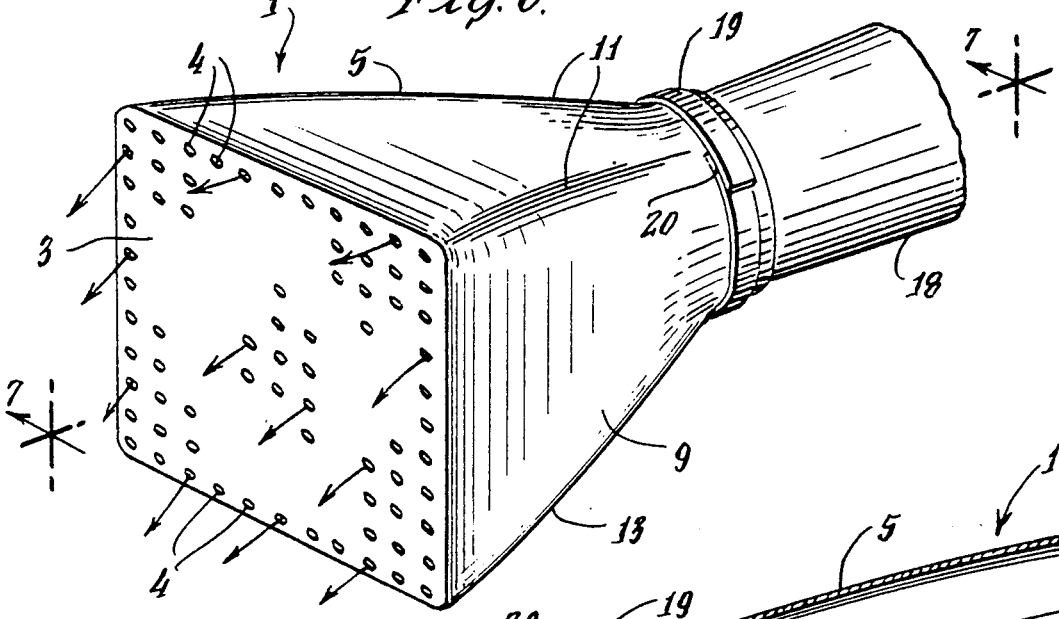
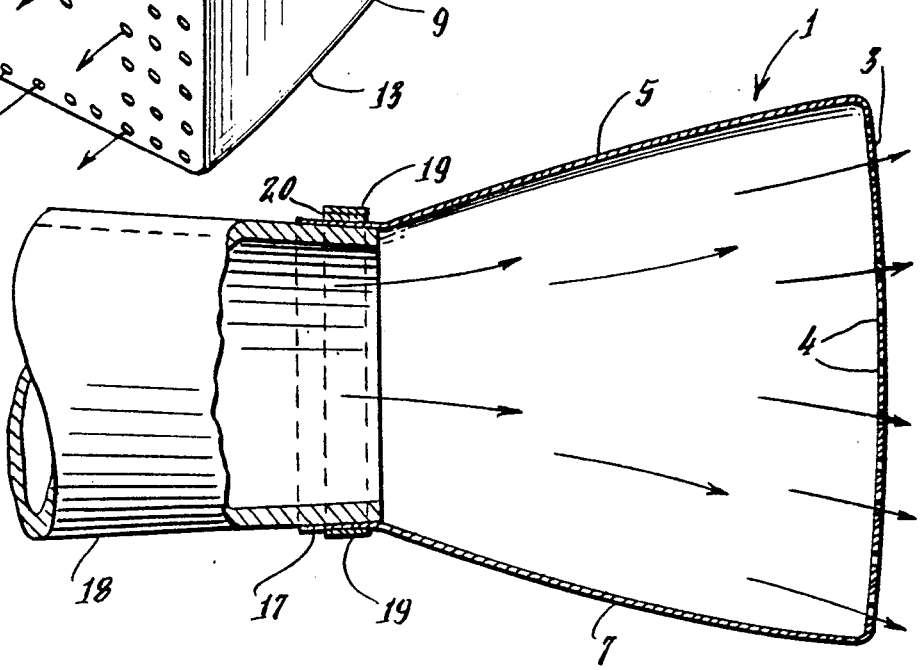
Fig. 7.

PLASTIC AIR DIFFUSER FOR HAIR DRYERS

FIELD OF THE INVENTION

This invention relates to the field of personal hair dryers, and, in particular, to air diffusers used with such dryers. Our diffuser, however, is not the large, rigid type usually found, but a foldable one made of plastic sheet material.

BRIEF SUMMARY OF THE INVENTION

Our diffuser is formed of plastic sheet material which, when unfolded has the shape of a truncated four-sided pyramid having a spout-like opening at its top to receive the air outlet of a hair dryer, and a plurality of holes in the base. In use, the top opening is secured about the air outlet; and the air enters through this opening, fills the diffuser, and leaves, diffused, through the openings in the base.

The diffuser is particularly useful when travelling, since it folds flat and, so, occupies practically no space in one's suitcase. Similarly, it takes up but little shelf space in a retail store.

The diffuser is made from a single, flexible sheet of polyethylene or other suitable plastic sheet material, cut to the correct shape to form the diffuser, and then heat sealed at the appropriate joints. Alternatively, an uncut sheet may be formed about a mandrel and cut into shape and heat sealed all in one operation.

DESCRIPTION OF THE DRAWINGS

FIG. 1 is a perspective view of the diffuser when folded.

FIGS. 2 and 3 are perspective views of the diffuser being unfolded.

FIG. 4 is a vertical section, taken on line 4—4 of FIG. 3.

FIG. 5 is a horizontal section, taken on line 5—5 of FIG. 4.

FIG. 6 is a perspective view of the diffuser mounted on the air outlet of a hair dryer, and in use, with air flowing out of holes in the base.

FIG. 7 is a vertical section taken on line 7—7 of FIG. 6.

DETAILED DESCRIPTION OF THE INVENTION

Figure 8:
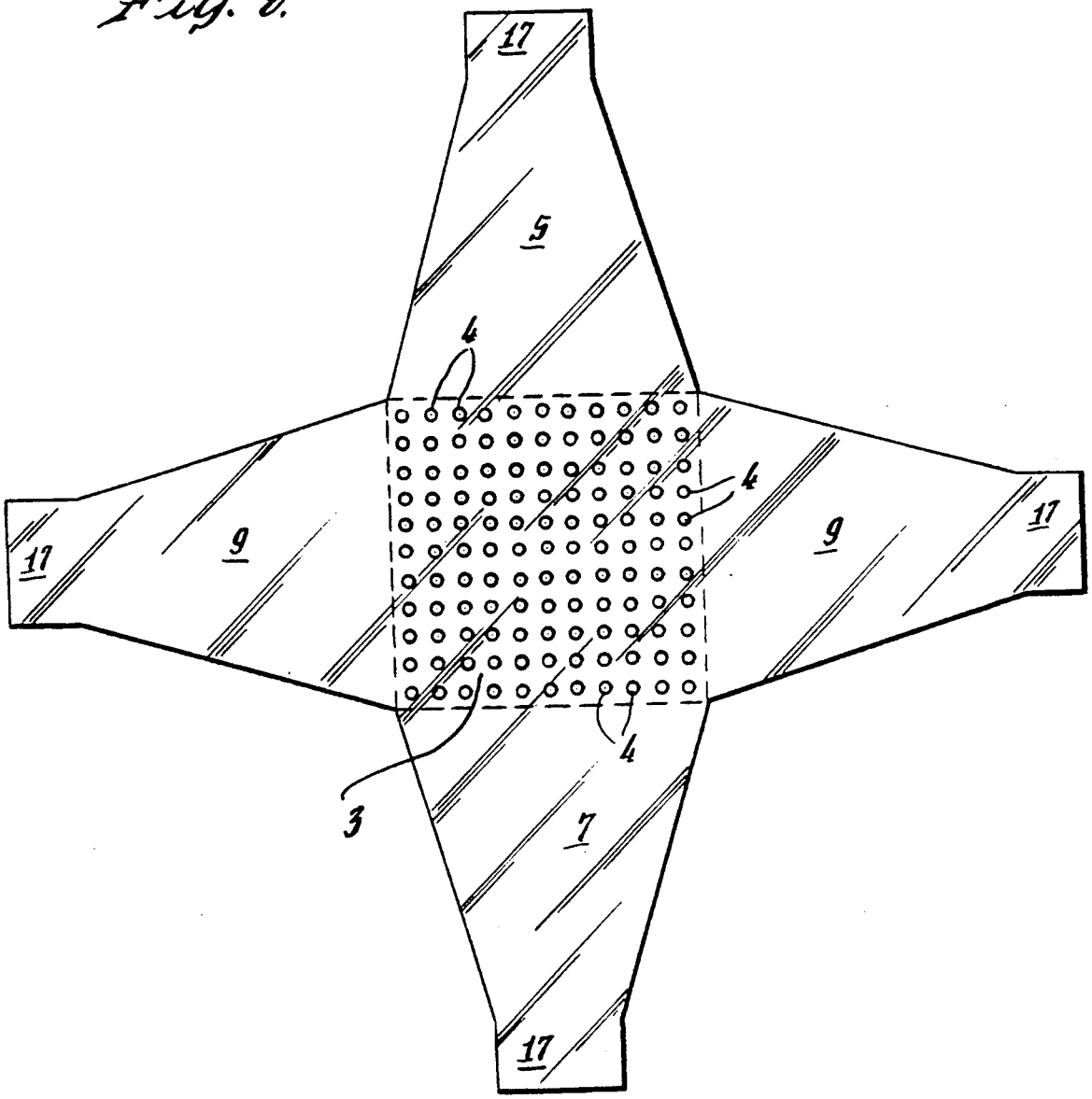
FIG. 8 is a piece of the plastic sheet material used in making our diffuser. It is cut into the shape it would be before heat sealing it together.

Diffuser 1 is shown in FIG. 1 in its folded position, as it would be when sold, when stored, or when carried in a suitcase. FIGS. 2 and 3 show it in stages of being unfolded. The diffuser includes a diffuser face 3 with numerous small holes 4, a top panel 5, a bottom panel 7, and sides 9. The edges of the top panel 5 and the edges of the two sides 9 are heat sealed together along line 11, which is also a fold line. The edges of the bottom panel 7 and the edges of the two sides 9 are heat sealed together along line 13, which is also a fold line.

The air inlet end of the diffuser is spout connector 17, which is simply an extension of the top, bottom, and side panels having a perimeter slightly greater than that of a hair dryer air outlet 18. An elastic member 19, having velcro 20 or other securing means on its ends, is adhered to the outside of spout connector 17. This can be used to snugly hold the spout connector against dryer air outlet 18.

In use, the diffuser is unfolded and spout connector 17 secured about the dryer air outlet. ,The dryer is turned on causing air to fill the plenum 23 formed by the top, side, and bottom panels. The continuing flow of air results in a diffuse stream of air coming out through holes 4 in diffuser face 3, as shown in FIGS. 6 and 7.

Our diffuser 1 is made from a sheet of thermoplastic material having a fusing temperature high enough not to be affected by hot air from the dryer. A satisfactory material is low density polyethylene, LDPE, with a thickness of about 1 mil. The fusing temperature should be high enough so that it can handle hot air from a dryer without fusing. A fusing temperature of 200 degrees Fahrenheit or higher is satisfactory.

To make the diffuser, a sheet of the plastic about 17 inches square is cut into the shape shown in FIG. 8. We have found that satisfactory dimensions would be to have a 5 inch square diffuser face 3; top, bottom, and side panels 5, 7, and 9 in the shape of truncated triangles, measuring 5 inches across the base and 5 inches on the sides, with a truncated top of about 2 inches. The spout connector 17 would extend upwardly from the truncated top about an inch. These pieces would be integral with one another as shown in FIG. 8.

The edges of the top and side panels and of their respective portion of the spout connector are then heat sealed together. The edges of the side and bottom panels are similarly sealed. The result will be a truncated four-sided pyramid with a spout-like opening at the top. An elastic 19 with a velcro fastener 20 is then secured to the outside of the spout connector with adhesive or by heat sealing. The diffuser may then be folded.

We claim:

1. An air diffuser for attachment to the air outlet of a hair dryer, said air diffuser including a porous diffuser face, panels secured to said diffuser face and to one another to form a plenum chamber, said face and said panels being formed of flexible, plastic sheet material, said panels having the shape of a truncated triangle, said plenum chamber having a spout opposite said face and integral with said panels to receive said air outlet, means for securing said spout to said air outlet, and said top, bottom, and side panels and said spout being formed from a single sheet of said flexible, plastic material, said panels and said diffuser face being secured together by heat sealing, whereby air coming from said air outlet will enter said plenum chamber through said spout and exit through said porous face.

2. An air diffuser as set forth in claim 1 in which said flexible, plastic sheet material is low density polyethylene.

3. An air diffuser for attachment to the air outlet of a hair dryer, said air diffuser including an air diffusion face having a plurality of spaced holes therein, panel members secured to said air diffusion face and to one another to form an air plenum chamber having an opening therein opposite said air diffusion face, a spout connector secured about said opening to receive said air outlet, and said air diffusion face, said panel members, and said spout connector being formed from a single sheet of flexible plastic sheet material, said face and said panel members being secured together by heat sealing, whereby air entering said plenum chamber from said air outlet will pass through said spaced holes, thereby being diffused.

4. An air diffuser as set forth in claim 3 in which said flexible plastic sheet material is low density polyethylene.

5. An air diffuser as set forth in claim 3 including a velcro strap attached to said spout connector whereby said spout connector can be held in contact with said air outlet.

6. An air diffuser for attachment to the air outlet of a hair dryer, said air diffuser including a porous diffuser face, panels secured to said diffuser face and to one another to form a plenum chamber, said plenum chamber having a spout opposite said face to receive said air outlet, said spout being integral with said panels, means for securing said spout to said air outlet, and said top, bottom, and side panels and said spout being formed from a single sheet of said flexible, plastic material, and said panels and said diffuser face being secured together by heat sealing, whereby air coming from said air outlet will enter said plenum chamber through said spout and exit through said porous face.

7. An air diffuser as set forth in claim 6 in which said panels have the shape of truncated triangles.

* * * * *